United States Patent [19]

Daney

[11] Patent Number: 4,605,838

[45] Date of Patent: Aug. 12, 1986

[54] ELECTRIC VAPOR BOILER

[75] Inventor: Georges J. Daney, Sceaux, France

[73] Assignee: Service National Electricite de France, France

[21] Appl. No.: 675,945

[22] Filed: Nov. 28, 1984

[30] Foreign Application Priority Data

Nov. 29, 1983 [FR] France ..... 83 19025

[51] Int. Cl.[4] ..... H05B 3/82; F22B 1/28; F24H 1/22

[52] U.S. Cl. ..... 219/319; 219/275; 219/307; 219/320; 219/523; 338/316

[58] Field of Search ..... 219/306, 307, 310, 312, 219/314, 316, 318, 319, 335, 336, 271–276, 320, 321, 290, 523; 122/13 A, 4 A; 338/316

[56] References Cited

U.S. PATENT DOCUMENTS

| | | | |
|---|---|---|---|
| 1,320,941 | 11/1919 | Taylor | 219/335 |
| 1,448,510 | 3/1923 | Armstrong | 219/319 |
| 1,548,742 | 8/1925 | Pou | 219/319 |
| 1,691,943 | 11/1928 | Steere | 219/319 |
| 1,695,803 | 12/1928 | Eimer | 219/319 |
| 1,725,683 | 8/1929 | Stubbs et al. | 219/319 X |
| 2,026,809 | 1/1936 | Winn | 219/307 |
| 2,149,667 | 3/1939 | Clarke | 219/273 |
| 3,025,381 | 3/1962 | Pickering | 219/319 |
| 3,346,718 | 10/1967 | Cooley et al. | 219/307 X |

FOREIGN PATENT DOCUMENTS

| | | | |
|---|---|---|---|
| 103377 | 2/1938 | Australia | 219/319 |
| 115162 | 5/1942 | Australia | 219/335 |

*Primary Examiner*—Anthony Bartis

*Attorney, Agent, or Firm*—McGlew and Tuttle

[57] ABSTRACT

An electric vapor boiler has a closed vessel (1) containing water, a steam or vapor outlet conduit (4), a conduit (6) supplying liquid and/or returning condensed vapor, and a electric resistance heating device (7) for each high or medium boiler voltage phase immersed in the water. Each heating device (7) includes a bare metallic resistance wire (8) immersed in the water and mounted in such a manner as to vibrate between a pair of vertical open-ended cylinders (13, 14) forming insulating screens. Each wire (8) is directly connected between a phase terminal (11) and ground, that is, the vessel (1) and has a plurality of parallel vertically spaced spires (18) offset symetrically with respect to each other on each side of a generatrix (16) of an oblique surface in the enclosure between the cylinders (13, 14) and extending obliquely to the vertical direction in the vessel (1). The outer cylinder (13) extends above the surface of the water. Alternatively, each wire can be formed as a plurality of parallel strands (38) and be positioned in an open-ended vertically disposed tube (33) having an oblong cross sectional shape.

14 Claims, 7 Drawing Figures

ELECTRIC VAPOR BOILER

The present invention relates to a vapor boiler or generator.

Electric vapor boilers of the type employing resistances used in industry usually comprise a closed enclosure or vessel containing water or other liquid heated by heating elements employing electric resistance which are immersed in the water or other liquid.

Heating elements employed up to the present time are formed by fluidtight insulating sheaths in which are disposed electric resistances which impart their heat to the surrounding water through these sheaths.

These elements are expensive to manufacture and their thermal transfer coefficient is low and their design requires a low-voltage supply which is expensive for high powers.

An object of the invention is to overcome these drawbacks and to provide an electric vapor boiler comprising electric heating means which may be supplied with high- or medium-voltage current having a high thermal transfer coefficient and in which the conventional heating elements are replaced by new devices which are easy to manufacture and very cheap and enable high power units to be constructed within a small volume.

The invention therefore provides an electric vapor boiler of the type comprising a closed vessel containing the water or other liquid, a vapor outlet conduit, a conduit supplying liquid or returning the condensed vapor, electric supply terminals and heating means including electric resistances immersed in the liquid, wherein said heating means comprise, for each phase of high or medium voltage, a bare metal wire directly immersed in the liquid and mounted to vibrate between insulating screens.

According to one embodiment of the invention, each of said bare wires mounted to vibrate is directly connected between a phase terminal and the ground, that is, the vessel.

According to another feature of the invention, said screens are disposed vertically in the liquid on each side of said wire and extend upwardly beyond the surface of the liquid.

According to another feature of the invention, the metal wire is disposed in such manner as to possess parallel or roughly concentric portions which are offset on each side of a generatrix of an oblique surface.

In one embodiment of the invention, said surface is conical or in the form of a pyramid and said wire forms a spiral whose spires are offset on each side of said surface within an enclosure formed by a circular screen.

Preferably, a second circular screen is disposed in concentric relation to the first screen and inside the latter and said spiral is disposed in the gap between the screens.

In a modification, said surface is planar and the parallel portions of the wire are offset on each side of the planar surface which is located between two parallel screens.

The following description with reference to the accompanying drawings of non-limiting embodiments will explain how the present invention can be carried out.

Figure 1:
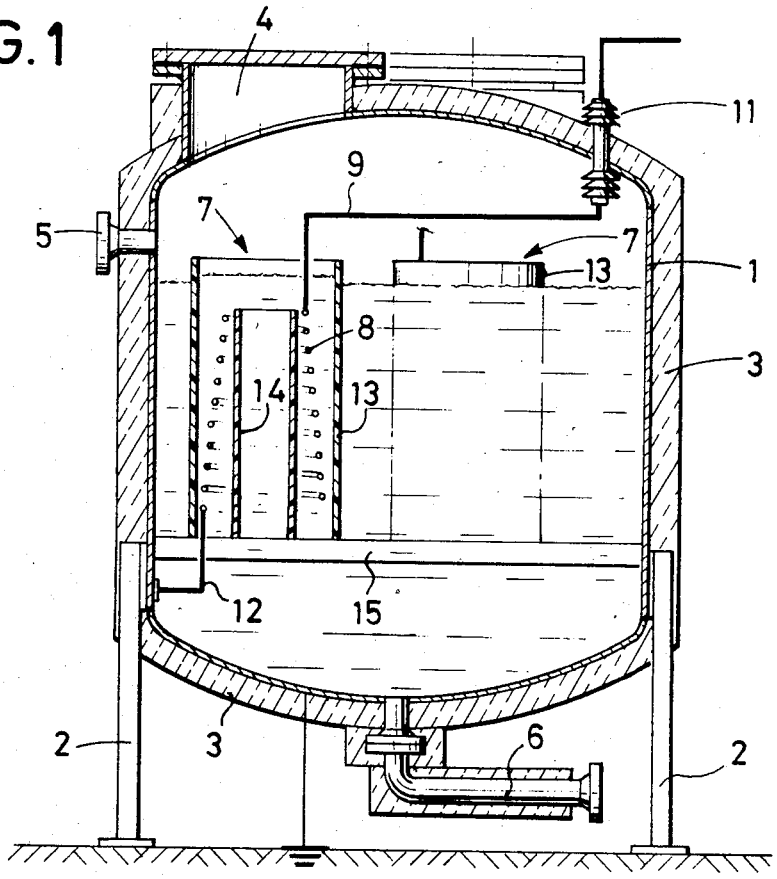
FIG. 1 is an elevational and sectional view of an electric vapor boiler according to the invention.
Figure 2:
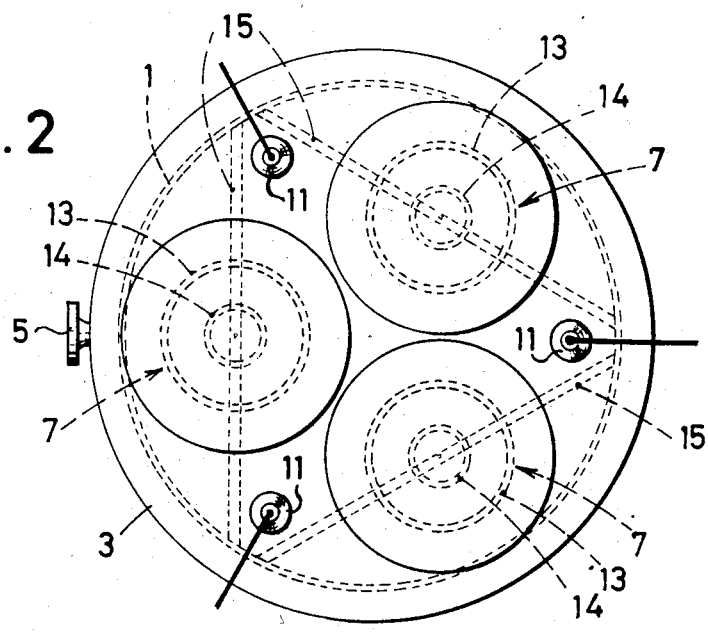
FIG. 2 is a top plan view thereof.

With reference to the drawings and more particularly FIGS. 1 and 2, the vapor boiler or generator according to the invention comprises in the known manner a vessel 1 supported by legs 2 and covered with a thermal insulator 3. The boiler has in its upper part an access opening 4, a vapor outlet conduit 5 and, in its lower part, a conduit 6 for the return of the condensed vapor.

In the illustrated embodiment, the boiler employs a three-phase current and includes three identical heating devices 7, namely one for each phase of the current supply. As these heating devices are identical, only one thereof will be described.

The heating device 7 comprises a non-insulated continuous conductor 8 which is directly immersed in the water in the vessel 1.

The conductor 8 forms a spiral whose spires or turns are vertically arranged in steps behind a screen constituting an insulating enclosure.

The upper end of the conductor 8 is connected through a conductor 9, to a supply terminal through the vessel 1 with interposition of an insulator 11.

The lower end of the conductor 8 is connected, through a conductor 12, to ground, that is, the vessel 1.

The spiral formed by the conductor 8 is disposed within a double insulating enclosure which is formed, in the illustrated embodiment, by two concentric tubular screens 13 and 14 of an electrically insulating material, disposed vertically, supported by a horizontal cross-member 15 and open at their ends.

Figure 3:
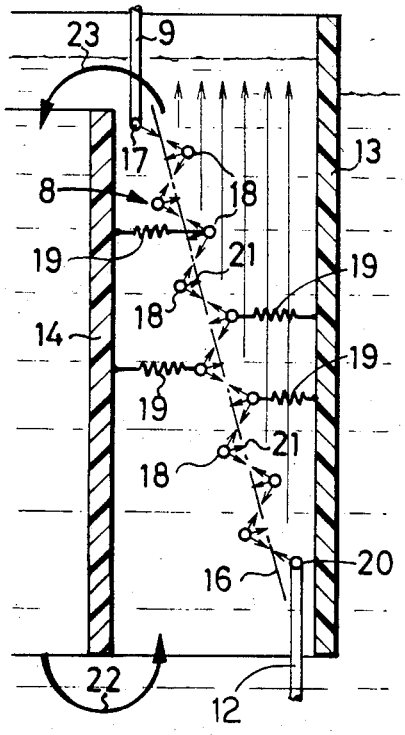
FIG. 3 is a partial sectional view to an enlarged scale of one of the heating devices of the boiler shown in FIG. 1.

Reference will now be made to FIG. 3 which is a diagrammatic partial view to an enlarged scale of the arrangement of the conductor 8 in the insulating enclosure.

The upper end of the outer tubular screen 13 extends upwardly beyond the level of the water, or other liquid contained in the vessel, while the upper end of the inner tubular screen 14 extends upwardly only to within a given distance below the surface of the water.

In the circular enclosure defined between the tubular screens 13 and 14, the spires formed by the bare conductor are offset on each side of a generatrix 16 of a frustoconical surface whose small base is located at the top, below the surface of the water roughly at the level of the upper end of the inner tube 14, as shown at 17 at the connection of the upper end of the spiral with the phase conductor 9.

The spires 18 are held in position by elastic means 19 which operate under tension and are alternately secured to the outer and inner tubes.

The lower end 20 of the spiral is connected to ground as mentioned above, i.e. to the vessel 1.

Owing to this arrangement of the spires 18 on each side of the generatrix 16, when the current is carried by these spires, electromagnetic forces are created in each spire and each one thereof is thus attracted toward the closest neighbouring spire, as shown by the arrows, and this attraction is exerted on each one in opposite directions, which produces a resultant indicated by the arrows 21 which are oriented in roughly opposite directions on the alternating spires. There is consequently a continuous vibration of these spires.

As a result, the bubbles of steam or vapour which are formed on the spires when the conductor 8 carries current become detached and rise to the surface of the water, as indicated by the vertical arrows in the right part of FIG. 3, and thus entrain the heated water in the upward direction. This rise of the water and steam is compensated for by an arrival of water indicated by an arrow 22, while the hot water passes over the upper end of the central tube 14 and is recycled as indicated by arrow 23. There is thus produced a continuous circulation of water which results in an improved thermal transfer coefficient.

With reference again to FIG. 1, it will be observed that as the outer insulating tubular screen 13 extends beyond the surface of the water in respect of each heating device connected to a phase of the supply, the leakage lines between the conductors 9 and between the latter and the ground are too long to enable a leakage current to be established.

As the insulating enclosures of each heating device are open at their lower end, a general circulation of the water is established in the vessel between the various devices, which circulation accelerates the rise in the temperature of the liquid.

Figure 4:
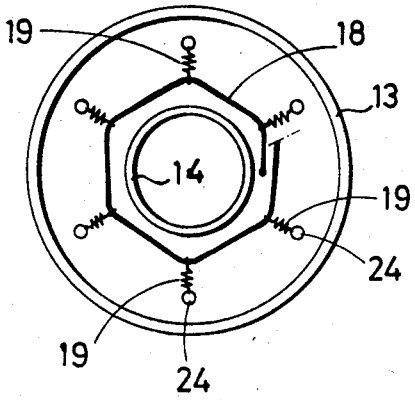
FIG. 4 is a top plan view of a modification of the heating device of FIG. 3.

FIG. 4 shows a modification of the attachment of the spires 18 of the conductor 8, in which the elastic means 19 are secured to rigid posts 24 of an insulating material, for example ceramic, disposed between the concentric tubular screens 13 and 14.

Figure 5:
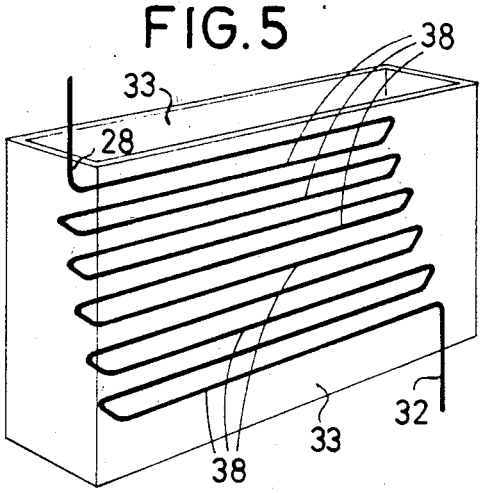
FIG. 5 is a perspective view of another embodiment of a heating device.
Figure 6:
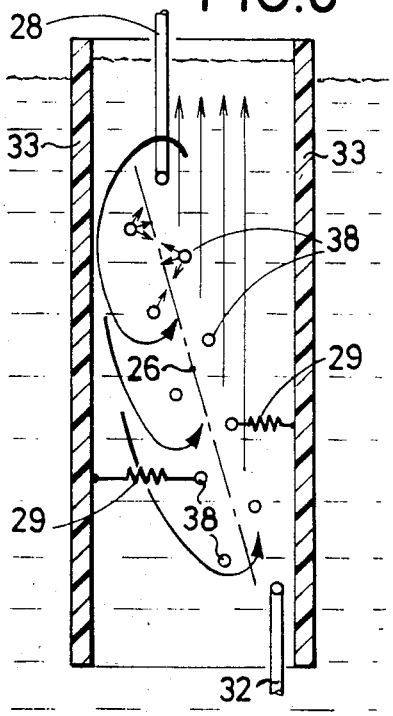
FIG. 6 is an end elevational view and sectional view of the device shown in FIG. 5.

FIGS. 5 and 6 show an embodiment of the heating devices in which the conductor 28 is disposed in an insulating enclosure or screen formed by a tube of oblong section, for example rectangular section, whose two large parallel walls 33 define a space in which the conductor 28 is disposed in such manner as to have parallel portions 38.

With reference to FIG. 6, it can be seen that the parallel portions 38 of the conductor 28 are generally disposed in such manner as to be offset relative to a generatrix 26 of an oblique surface, thereby also producing vibrations of the portions 38 which cause the bubbles of steam to become detached, these bubbles rising to the surface and entraining the hot water inside the enclosure and producing at the same time an arrival of cold water, as indicated by the curved arrows in FIG. 6. The upper end of the conductor 28 is connected to the phase conductor 29 and its lower end is connected to ground through a conductor 32.

In this embodiment, the portions 38 of the conductor can also be maintained in position by elastic means 29 in a way similar to that described with reference to FIG. 3.

Figure 7:
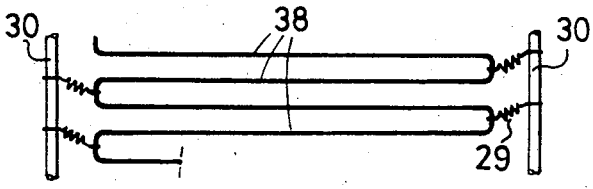
FIG. 7 is a view of a modification of the attachment of the conductor of the device shown in FIGS. 5 and 6.

In a modification shown in FIG. 7, the portions 38 of the conductor are carried by rigid supports 30 with interposition of elastic means 29.

There is established in each heating device and in the water, which is slightly conductive, an electric current between the elements of the metal conductor which have a difference of potential. This current, which is parallel to the principal current, also participates in the transmission of thermal energy to the water.

The geometry of the devices, the sections of the passage of the current in the water, the distances between the conductor elements at different potentials enables, for a given supply voltage, the value of this current to be predetermined. This value is limited in such manner that, in accordance with the nature and the geometry of the chosen conductor, it does not result, by the effect of hydrolysis, in a hydrogen and oxygen content incompatible with the considered utilization.

The high thermal transfer coefficients obtained enable the boiler to be supplied with high- and medium-voltage current which constitutes an economical solution for high-power apparatus.

The nature and the sectional shape of the metal conductor are so chosen that it withstands the high temperatures to which it is subjected in the boiler, it does not undergo oxidation or chemical attack at this temperature and has a sufficient electric resistivity not to require an excessively long length. There is for example employed an Ni-Cr steel comprising 70% nickel and 30% chromium which has a resistivity on the order of 1.2 ohms. $mm^2/m$.

Further, the electrically insulating screens between phases will be made from a material which does not absorb water under pressure so that they retain their insulating properties in permanent immersion, for example from porcelain or from a plastics material of the polytetrofluorethylene or other type.

It will be observed that the boiler according to the invention permits the use of a softened water which is non-demineralized, which constitutes another important advantage.

What is claimed is:

1. An electric vapor boiler comprising a closed vessel containing a liquid to be vaporized, a vapor outlet conduit connected to said vessel for discharge vapors therefrom, a supply conduit connected to said vessel for supplying liquid thereto, a plurality of multi-phase electric supply terminals connected through through said vessel, electric resistance heating means for vaporizing liquid in said vessel and having a plurality of bare wires each connected to one of said supply terminals and each immersed in the liquid, a plurality of outer insulating screens disposed in said vessel with each screen disposed around one of said bare wires, each bare wire having a plurality of parallel spires spaced vertically in said vessel and offset symmetrically with respect to each other on each side of a generatrix of an oblique surface extending obliquely to a vertical direction in said vessel, and mounting means connected to said bare wires for mounting said bare wires in said vessel so as to vibrate in said outer screens.

2. A boiler according to claim 1, wherein said bare wires are each directly connected between a phase terminal and the vessel which is grounded.

3. A boiler according to claim 1, wherein said outer screens are disposed vertically in the liquid around said wires and extend vertically above the surface of the liquid.

4. A boiler according to claim 3, wherein each bare wire is in the form of a spiral having turns, each turn comprising a spire, said oblique surface comprising an upwardly tapering surface with adjacent turns alternating on the inside and the outside of said tapering surface.

5. A boiler according to claim 4, wherein said tapering surface is a conical surface.

6. A boiler according to claim 4, wherein said tapering surface is a pyramidal surface.

7. A boiler according to claim 4, wherein said mounting means comprises rigid insulating supports, elastic means connected to the supports and connected to the wire for suspending the wire.

8. A boiler according to claim 7, wherein said supports are formed by said screens.

9. A boiler according to claim 7, wherein said supports are formed by posts disposed between said screens.

10. A boiler according to claim 4, wherein each outer screen is cylindrical, and including an inner cylindrical screen inside each spiral bare wire forming an annular enclosure space with an outer cylindrical screen for enclosing the spiral bare wire.

11. A boiler according to claim 10, wherein each inner cylindrical screen has an upper edge immersed in the liquid.

12. A boiler according to claim 11, wherein each inner and outer cylindrical screen has a lower edge immersed in the liquid.

13. A boiler according to claim 3, wherein each bare wire comprises a plurality of parallel strands forming said parallel spires said oblique surface comprising a plane, adjacent strands being positioned on opposite sides of said planer surface.

14. A boiler according to claim 13, wherein each screen is formed by a tube having an oblong cross-sectional shape.

* * * * *